US009289030B2

(12) United States Patent
Peyton et al.

(10) Patent No.: US 9,289,030 B2
(45) Date of Patent: Mar. 22, 2016

(54) ARTICLE OF FOOTWEAR HAVING A SOLE STRUCTURE WITH A FRAMEWORK-CHAMBER ARRANGEMENT

(71) Applicant: NIKE, Inc., Beaverton, OR (US)

(72) Inventors: Lee D. Peyton, Tigard, OR (US); Andrew C. Richards, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/324,968

(22) Filed: Jul. 7, 2014

(65) Prior Publication Data

US 2015/0007458 A1 Jan. 8, 2015

Related U.S. Application Data

(63) Continuation of application No. 12/777,521, filed on May 11, 2010, now Pat. No. 8,782,924.

(51) Int. Cl.

| | |
|---|---|
| ***A43B 13/20*** | (2006.01) |
| ***A43B 13/18*** | (2006.01) |
| ***A43B 13/12*** | (2006.01) |
| ***A43B 13/26*** | (2006.01) |

(52) U.S. Cl.

CPC ..... *A43B 13/18* (2013.01); *A43B 13/122* (2013.01); *A43B 13/20* (2013.01); *A43B 13/206* (2013.01); *A43B 13/26* (2013.01)

(58) Field of Classification Search

USPC ..... 36/29, 35 B, 153

See application file for complete search history.

(56) References Cited

U.S. PATENT DOCUMENTS

| | | | |
|---|---|---|---|
| 4,183,156 | A | 1/1980 | Rudy |
| 4,219,945 | A | 9/1980 | Rudy |
| 4,223,455 | A | 9/1980 | Vermeulen |

(Continued)

FOREIGN PATENT DOCUMENTS

| | | | |
|---|---|---|---|
| CN | 101005773 | A | 7/2007 |
| EP | 0399332 | A1 | 11/1990 |

(Continued)

OTHER PUBLICATIONS

Extended European search report for EP Application No. 14167799.7, mailed Jun. 10, 2014.

(Continued)

*Primary Examiner* — Ted Kavanaugh

(74) *Attorney, Agent, or Firm* — Honigman Miller Schwartz and Cohn LLP; Mathew H. Szalach; Jonathan P. O'Brien

(57) ABSTRACT

A framework-chamber arrangement for an article of footwear, and an article of footwear having a sole structure including a framework-chamber arrangement, is provided that can cooperate to provide various advantageous features, such as multiple-stage cushioning and specialized attenuation of and reaction to ground contact forces. The framework-chamber arrangement can include a fluid-filled chamber forming laterally extending arms and a framework having corresponding recesses formed therein and receiving a lower portion of the chamber. The fluid-filled chamber can be retained within the framework without a bond being formed between lower regions of the chamber arms and the framework. Peripheral portions of some of the chamber arms can be spaced apart from adjacent portions of corresponding channels while in a relaxed state.

10 Claims, 11 Drawing Sheets

(56) References Cited

U.S. PATENT DOCUMENTS

| | | | | |
|---|---|---|---|---|
| 4,340,626 | A | 7/1982 | Rudy | |
| 4,826,725 | A | 5/1989 | Harlow | |
| 4,936,029 | A | 6/1990 | Rudy | |
| 5,042,176 | A | 8/1991 | Rudy | |
| 5,367,791 | A | 11/1994 | Gross et al. | |
| 5,673,500 | A | 10/1997 | Huang | |
| 5,713,141 | A | 2/1998 | Mitchell et al. | |
| 5,755,001 | A | 5/1998 | Potter et al. | |
| 5,771,606 | A | 6/1998 | Litchfield et al. | |
| 5,952,065 | A | 9/1999 | Mitchell et al. | |
| 6,013,340 | A | 1/2000 | Bonk et al. | |
| 6,055,746 | A * | 5/2000 | Lyden et al. | 36/29 |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,463,612 | B1 * | 10/2002 | Potter | 12/146 B |
| 6,505,420 | B1 | 1/2003 | Litchfield et al. | |
| 6,745,499 | B2 | 6/2004 | Christensen et al. | |
| 6,837,951 | B2 | 1/2005 | Rapaport | |
| 6,845,573 | B2 | 1/2005 | Litchfield et al. | |
| 6,990,755 | B2 | 1/2006 | Hatfield et al. | |
| 7,000,335 | B2 | 2/2006 | Swigart et al. | |
| 7,086,180 | B2 | 8/2006 | Dojan et al. | |
| 7,132,032 | B2 | 11/2006 | Tawney et al. | |
| 7,141,131 | B2 | 11/2006 | Foxen et al. | |
| 7,200,955 | B2 * | 4/2007 | Foxen | A43B 7/1425 36/25 R |
| 7,555,851 | B2 | 7/2009 | Hazenberg et al. | |
| 7,707,745 | B2 | 5/2010 | Schindler et al. | |
| 7,752,772 | B2 | 7/2010 | Hatfield et al. | |
| 8,782,924 | B2 | 7/2014 | Peyton et al. | |
| 2004/0098882 | A1 | 5/2004 | Tuan | |
| 2007/0107266 | A1 * | 5/2007 | Sun | 36/127 |
| 2007/0113425 | A1 * | 5/2007 | Wakley et al. | 36/28 |
| 2007/0169376 | A1 | 7/2007 | Hatfield et al. | |
| 2007/0277401 | A1 | 12/2007 | Young-Chul | |
| 2008/0184595 | A1 * | 8/2008 | Schindler et al. | 36/29 |
| 2009/0056172 | A1 | 3/2009 | Cho | |
| 2010/0251578 | A1 | 10/2010 | Auger et al. | |

FOREIGN PATENT DOCUMENTS

| | | | |
|---|---|---|---|
| EP | 1728446 | A1 | 12/2006 |
| WO | WO-2010062539 | A2 | 6/2010 |

OTHER PUBLICATIONS

Extended European search report for EP Application No. 14167798.9, mailed Jun. 24, 2014.

Extended European search report for EP Application No. 14167796.3, mailed Sep. 26, 2014.

First Office Action for Chinese Patent Application No. 201180023229.1, issued Sep. 15, 2014.

Non-Final Office Action for U.S. Appl. No. 14/324,910, mailed Nov. 18, 2014.

Non-Final Office Action for U.S. Appl. No. 14/324,942, mailed Nov. 18, 2014.

International Preliminary Search Report for Application No. PCT/US2008/079078, mailed Jul. 1, 2010.

International Search Report and Written Opinion for Application No. PCT/US2011/031617, mailed Sep. 23, 2011.

European Patent Office, Communication pursuant to Article 94(3) EPC for EP Application No. 11722209.1, mailed Sep. 9, 2013.

* cited by examiner

ARTICLE OF FOOTWEAR HAVING A SOLE STRUCTURE WITH A FRAMEWORK-CHAMBER ARRANGEMENT

CROSS-REFERENCE TO RELATED APPLICATIONS

This non-provisional U.S. Patent Application is a continuation application and claims priority to U.S. patent application Ser. No. 12/777,521, which was filed in the U.S. Patent and Trademark Office on May 11, 2010 and entitled Article Of Footwear Having A Sole Structure With A Framework-Chamber Arrangement, such prior U.S. Patent Application being entirely incorporated herein by reference.

BACKGROUND

Conventional articles of athletic footwear include two primary elements: an upper and a sole structure. The upper is generally formed from a plurality of elements (e.g., textiles, foam, leather, synthetic leather) that are stitched or adhesively bonded together to form an interior void for securely and comfortably receiving a foot. The sole structure incorporates multiple layers that are conventionally referred to as a sockliner, a midsole, and an outsole. The sockliner is a thin, compressible member located within the void of the upper and adjacent to a plantar (i.e., lower) surface of the foot to enhance comfort. The midsole is secured to the upper and forms a middle layer of the sole structure that attenuates ground reaction forces during walking, running, or other ambulatory activities. The outsole forms a ground-contacting element of the footwear and is usually fashioned from a durable and wear-resistant rubber material that includes texturing to impart traction.

The primary material forming many conventional midsoles is a polymer foam, such as polyurethane or ethylvinylacetate. In some articles of footwear, the midsole can also incorporate a sealed and fluid-filled chamber that increases durability of the footwear and enhances ground reaction force attenuation of the sole structure. The fluid-filled chamber can be at least partially encapsulated within the polymer foam, as in U.S. Pat. No. 5,755,001 to Potter, et al., U.S. Pat. No. 6,837,951 to Rapaport, and U.S. Pat. No. 7,132,032 to Tawney, et al. In other footwear configurations, the fluid-filled chamber can substantially replace the polymer foam, as in U.S. Pat. No. 7,086,180 to Dojan, et al. In general, the fluid-filled chambers are formed from an elastomeric polymer material that is sealed and pressurized, but can also be substantially unpressurized. In some configurations, textile or foam tensile members can be located within the chamber or reinforcing structures can be bonded to an exterior surface of the chamber to impart shape to or retain an intended shape of the chamber.

Fluid-filled chambers suitable for footwear applications can be manufactured by a two-film technique, in which two separate sheets of elastomeric film are bonded together to form a peripheral bond on the exterior of the chamber and to form a generally sealed structure. The sheets are also bonded together at predetermined interior areas to give the chamber a desired configuration. That is, interior bonds (i.e., bonds spaced inward from the peripheral bond) provide the chamber with a predetermined shape and size upon pressurization. In order to pressurize the chamber, a nozzle or needle connected to a fluid pressure source is inserted into a fill inlet formed in the chamber. Following pressurization of the chamber, the fill inlet is sealed and the nozzle is removed. A similar procedure, referred to as thermoforming, can also be utilized, in which a heated mold forms or otherwise shapes the sheets of elastomeric film during the manufacturing process.

Chambers can also be manufactured by a blow-molding technique, wherein a molten or otherwise softened elastomeric material in the shape of a tube is placed in a mold having the desired overall shape and configuration of the chamber. The mold has an opening at one location through which pressurized air is provided. The pressurized air induces the liquefied elastomeric material to conform to the shape of the inner surfaces of the mold. The elastomeric material then cools, thereby forming a chamber with the desired shape and configuration. As with the two-film technique, a nozzle or needle connected to a fluid pressure source is inserted into a fill inlet formed in the chamber in order to pressurize the chamber. Following pressurization of the chamber, the fill inlet is sealed and the nozzle is removed.

SUMMARY

A framework-chamber arrangement for an article of footwear, and an article of footwear having a sole structure including a framework-chamber arrangement, can cooperate to provide various advantageous features, such as multiple-stage cushioning and specialized attenuation of and reaction to ground contact forces. The framework-chamber arrangement can include one or more fluid-filled chambers forming a plurality of laterally extending arms and a framework receiving a lower portion of the chamber. The framework can include a recess formed therein extending downward from its upper portion and having a plurality of laterally extending channels. The chamber arms can correspond with the framework channels and be retained therein. In some cases, the fluid-filled chamber can be retained within the framework without a bond being formed between lower regions of the chamber arms and the framework.

Another configuration of a framework-chamber arrangement can include a heel fluid-filled chamber forming a plurality of laterally extending arms, a forefoot fluid-filled chamber forming a plurality of laterally extending arms, and a framework having a plurality of recesses formed therein extending from its upper portion toward its lower portion including a plurality of laterally extending channels in each of the recesses. The plurality of recesses can include a heel recess for retaining a lower portion of the heel fluid-filled chamber without a bond being formed between lower regions of the arms of the heel fluid-filled chamber and the framework, and a forefoot recess for similarly retaining a lower portion of the forefoot fluid-filled chamber without a bond being formed between lower regions of the arms of the forefoot fluid-filled chamber and the framework. Peripheral portions of some of the lateral arms of the heel and forefoot fluid-filled chambers can be spaced apart from adjacent portions of corresponding channels while in a relaxed state.

Furthermore, a configuration of a sole structure including a framework-chamber arrangement may have a foam framework and a fluid-filled chamber. The foam framework may extend from a forefoot region to a heel region of the sole structure, and may also extend from a lateral side to a medial side of the sole structure. The foam framework may have a top portion and a bottom portion. The fluid-filled chamber may have a top portion, a plurality of web members, and a plurality of sub-chambers. A recess may extend from the top portion of the foam framework to the bottom portion of the foam framework. The plurality of web members may be formed from the top portion of the chamber and may be secured to the top portion of the foam framework. The plurality of sub-chambers may extend through and protrude outward from the recess.

The advantages and features of novelty characterizing aspects of the invention are pointed out with particularity in the appended claims. To gain an improved understanding of the advantages and features of novelty, however, reference can be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of fluid-filled chambers suitable for use in sole structures of articles of footwear and particularly in cooperative arrangements with resilient frameworks. Concepts related to the chambers and the sole structures are disclosed with reference to footwear having a configuration that is suitable for running. The chambers are not limited to footwear designed for running, however, and can be utilized with a wide range of athletic footwear styles, including basketball shoes, tennis shoes, football shoes, cross-training shoes, walking shoes, and soccer shoes, for example. The chambers can also be utilized with footwear styles that are generally considered to be non-athletic, including dress shoes, loafers, sandals, and boots. The concepts disclosed herein can, therefore, apply to a wide variety of footwear styles, in addition to the specific styles discussed in the following material and depicted in the accompanying figures.

General Footwear Structure

Figure 1:
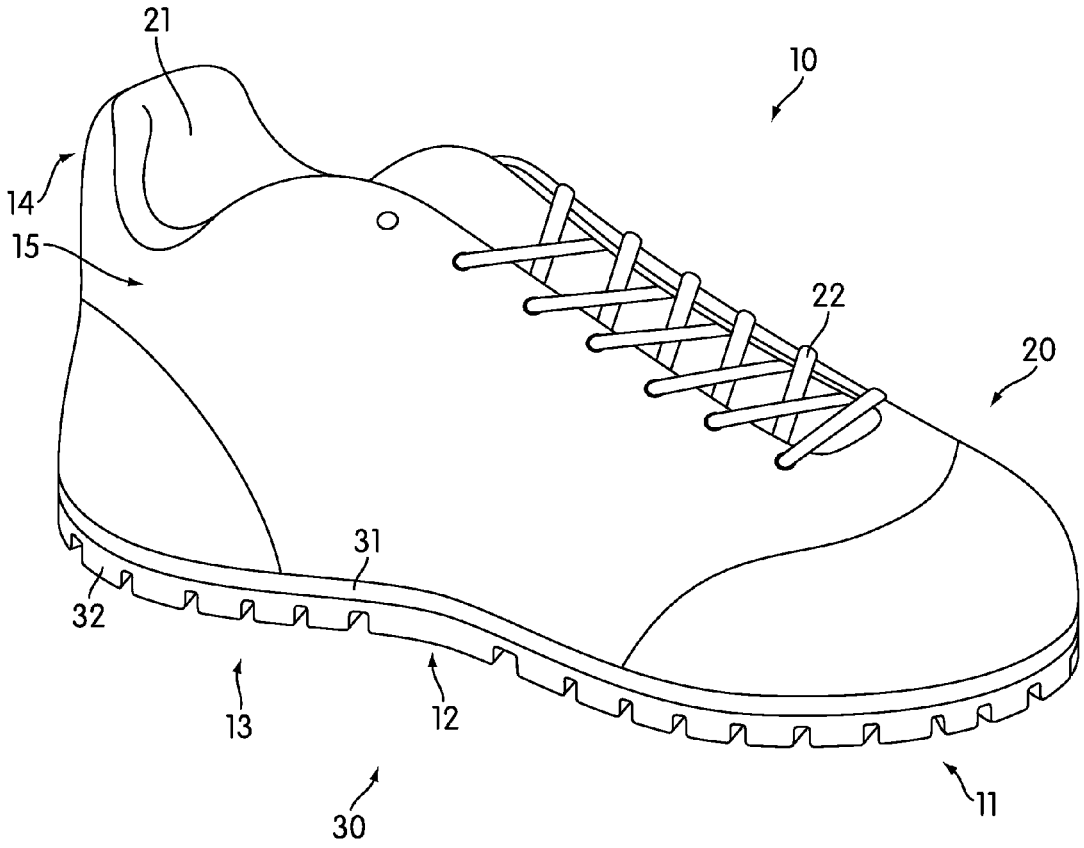
FIG. 1 is a perspective view of an article of footwear.
Figure 2:
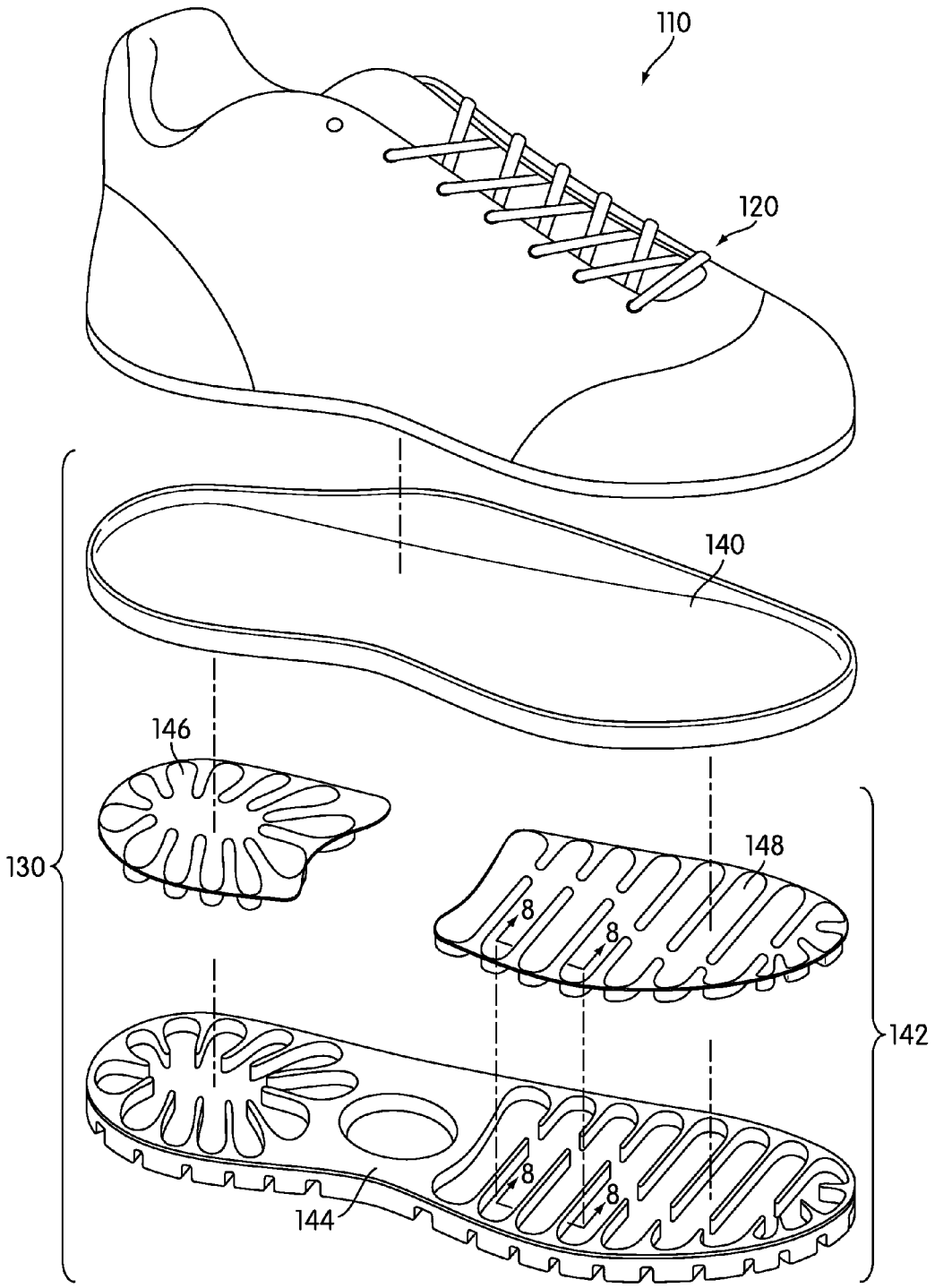
FIG. 2 is an exploded perspective view of another article of footwear having a framework-chamber arrangement in a portion of the sole structure including a resilient framework, a forefoot chamber and a heel chamber.

An article of footwear 10 is depicted in FIG. 1 as including an upper 20 and a sole structure 30. For reference purposes, footwear 10 can be divided into three general regions: a forefoot region 11, a midfoot region 12, and a heel region 13, as shown in FIG. 1. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 can also be applied to upper 20, sole structure 30, and individual elements thereof.

Upper 20 is depicted as having a substantially conventional configuration incorporating a plurality of material elements (e.g., textiles, foam, leather, and synthetic leather) that are stitched, adhesively bonded or otherwise attached together to form an interior void for receiving a foot securely and comfortably. The material elements can be selected and located with respect to upper 20 in order to impart properties of durability, air-permeability, wear-resistance, flexibility, and comfort, for example. An ankle opening 21 in heel region 13 provides access to the interior void. In addition, upper 20 can include a lace 22 that is utilized in a conventional manner to modify the dimensions of the interior void, thereby securing the foot within the interior void and facilitating entry and removal of the foot from the interior void. The lace can extend through apertures in upper 20, and a tongue portion of upper 20 can extend between the interior void and lace 22. Given that various aspects of the present application primarily relate to sole structure 30, upper 20 can exhibit the general configuration discussed above or the general configuration of practically any other conventional or non-conventional upper. Accordingly, the structure of upper 20 can vary significantly within the scope of the present invention.

Sole structure 30 is secured to upper 20 and has a configuration that extends between upper 20 and the ground. The primary elements of sole structure 30 are a midsole 31 and an outsole 32. Midsole 31 can be formed from a polymer foam material, such as polyurethane or ethylvinylacetate, that can encapsulate a fluid-filled chamber to enhance the ground reaction force attenuation characteristics of sole structure 30. In addition to the polymer foam material and the fluid-filled chamber, midsole 31 can incorporate one or more plates, moderators, or reinforcing structures, for example, that can further enhance the ground reaction force attenuation characteristics of sole structure 30 or the performance properties of footwear 10. Outsole 32, which can be absent in some configurations of footwear 10, is secured to a lower surface of midsole 31 and can be formed from a rubber material that provides a durable and wear-resistant surface for engaging the ground. Outsole 32 can also be textured to enhance the traction (i.e., friction) properties between footwear 10 and the ground. In addition, sole structure 30 can incorporate a sockliner (not depicted) that is located within the void in upper 20 and adjacent a plantar (i.e., lower) surface of the foot to enhance the comfort of footwear 10.

Framework-Chamber Arrangements

FIGS. 2 through 8 show an article of footwear 110 that generally includes the features discussed above with FIG. 1, except as discussed hereafter and particularly with respect to the cooperative combination of a resilient framework and one or more fluid-filled chambers (i.e., a framework-chamber arrangement). As shown, article of footwear 110 includes an upper 120 and a sole structure 130. Sole structure 130 may in turn have an insole 140 and a framework-chamber arrangement 142. The insole can include a conventional insole made from a foam material, such as polyurethane, which can form an upper portion of sole structure 130. The framework-chamber arrangement 142 can primarily form the midsole portion of the sole, and, in some cases, it can also form the outsole portion for engaging the ground. The framework-chamber arrangement 142 can include a resilient framework 144, a heel chamber 146 and a forefoot chamber 148. Resilient framework 144 can be formed from a variety of materials configured to support one or more chambers that can provide ground force reaction attenuation features. For example, resilient framework 144 may be a foam framework formed from a resilient foam material like polyurethane.

Resilient framework 144 can provide an evenly distributed structure around chambers 146 and 148 and their arms 150, and, in some cases, it can do so while being substantially free of bonds with arms 150. The resilient framework can position and retain the chamber arms while cooperating with them to provide various advantageous features for the sole structure, such as high flexibility, low weight, good transition, simplified assembly, multiple-stage cushioning, and the configuration of cushioning and reaction forces for particular benefits. Example configurations described below illustrate many advantageous features of framework-chamber arrangements, which can exist in various combinations and in other arrangements.

For instance, in some cases, bonds can exist between a resilient framework and the one or more chamber(s) along a footbed plane (e.g., a plane generally corresponding with the bottom of the user's foot) without having bonds between underside portions of the chamber arms and the resilient framework, which can provide advantages, such as multiple-stage cushioning and flexibility regarding cushioning and reaction force features. Further, gaps can exist between portions of the resilient framework and the chamber arms in a relaxed state, such as lateral portions of the chamber arms, to permit or enhance these features further. As such, a first type of cushioning can be provided at an early stage of engagement between the article of footwear and the ground based primarily on attenuation and reaction forces of the resilient framework while the chamber is being initially compressed. A second type of cushioning different from the first type can also be provided at a later stage of ground engagement based on interfering contact between portions of the resilient framework and the compressed fluid-filled chambers. In some configurations, portions of cushioning chambers can extend through the resilient framework to an outsole region to form outsole pods, which can provide a third type of cushioning at an even earlier stage of ground engagement based primarily on compression of the outsole pods.

Resilient framework 144 can be formed from various resilient materials including a polymer foam material, such as polyurethane or ethylvinylacetate. The resilient framework can partially or completely encapsulate one or more fluid-filled chambers to enhance the ground reaction force attenuation characteristics of sole structure 130. In addition, the resilient framework can include a primary material, such as a polymer foam material, configured with other support structures (not shown), like plates, springs, moderators, bridges, reinforcement structures, etc., which can be formed of one or more different materials and can be embedded within the first material.

Chambers 146 and 148 can be formed from a wide range of materials including various polymers that can resiliently retain a fluid, such as air or another gas. In selecting materials, engineering properties of the material can be considered (e.g., tensile strength, stretch properties, fatigue characteristics, dynamic modulus, and loss tangent), as well as the ability of the material to prevent diffusion of the fluid contained within the chamber. When formed of thermoplastic urethane, for example, the outer barrier of chambers 146 and 148 can have a thickness of approximately 1.0 millimeter, but the thickness can range from about 0.25 to 2.0 millimeters or more, for example. In addition to thermoplastic urethane, examples of polymer materials that can be suitable for chambers 146 and 148 can include polyurethane, polyester, polyester polyurethane, and polyether polyurethane. Chambers 146 and 148 can also be formed from materials that include alternating layers of thermoplastic polyurethane and ethylene-vinyl alcohol copolymer, such as disclosed in U.S. Pat. Nos. 5,713,141 and 5,952,065 to Mitchell, et al.

A variation upon this material can also be utilized, such as wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for chambers 146 and 148 can be a flexible microlayer membrane that includes alternating layers of a gas barrier material and an elastomeric material, such as disclosed in U.S. Pat. Nos. 6,082,025 and 6,127,026 to Bonk, et al. Additional suitable materials can include those disclosed in U.S. Pat. Nos. 4,183,156 and 4,219,945 to Rudy. Further suitable materials can include thermoplastic films containing a crystalline material, such as disclosed in U.S. Pat. Nos. 4,936,029 and 5,042,176 to Rudy, and polyurethane including a polyester polyol, such as disclosed in U.S. Pat. Nos. 6,013,340; 6,203,868; and U.S. Pat. No. 6,321,465 to Bonk, et al.

The polymer material forming the exterior or outer barrier of chambers 146 and 148 can each enclose a fluid that can be at atmospheric pressure or that can be pressurized between zero and three-hundred-fifty kilopascals (i.e., approximately fifty-one pounds per square inch) or more, with a pressure of zero representing the ambient air pressure surrounding chambers 146 and 148 at sea level. In addition to air and nitrogen, the fluid contained by chambers 146 and 148 can include octafluorapropane or be any of the gasses disclosed in U.S. Pat. No. 4,340,626 to Rudy, such as hexafluoroethane and sulfur hexafluoride, for example. In some configurations, chambers 146 and 148 can incorporate a valve that permits the user to adjust the pressure of the fluid.

Referring to FIGS. 3 through 5B, heel chamber 146 and forefoot chamber 148 can each include a plurality of chamber arms 150 that can be interconnected by a web 154. The interconnecting web 154 can be formed from a top portion of each chamber 146 and 148 and can include web members 156 connecting adjacent chamber arms 150 to one another. Web 154 and interconnecting web members 156 can have various thicknesses as appropriate for desired features such as flexibility between the chamber arms. Each of chambers 146 and 148 may additionally have lower portions 167.

Figure 3:
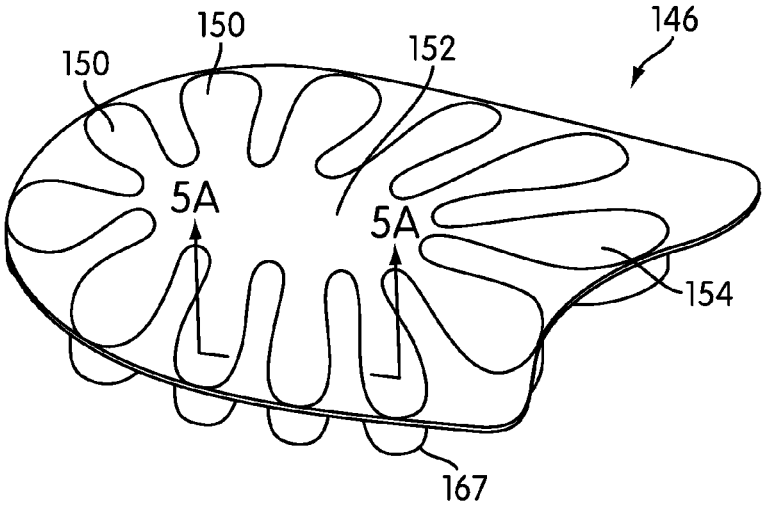
FIG. 3 is a perspective view of the heel chamber of FIG. 2.
Figure 4:
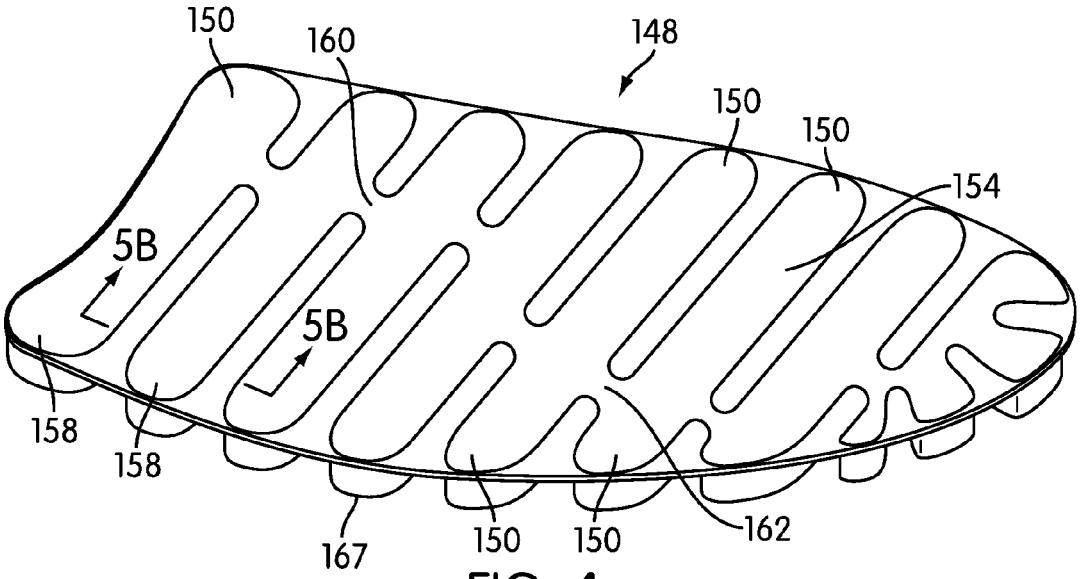
FIG. 4 is a perspective view of the forefoot chamber of FIG. 2.
Figure 5A:
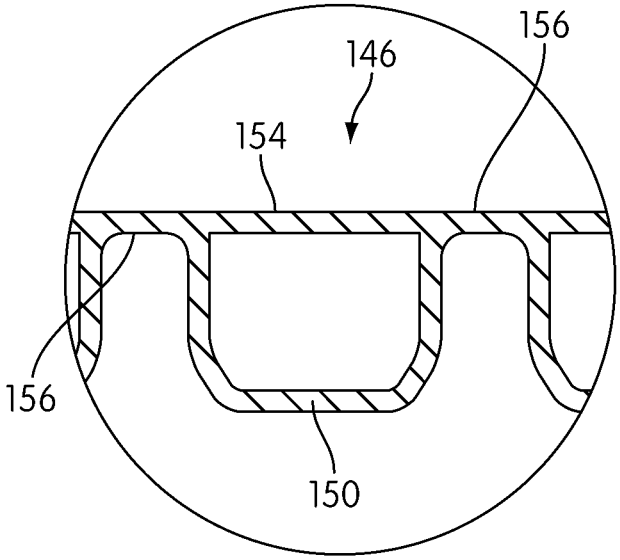
FIG. 5A is a cross-sectional view of a portion of the heel chamber of FIGS. 2 and 3 taken along line 5A-5A of FIG. 3.
Figure 5B:
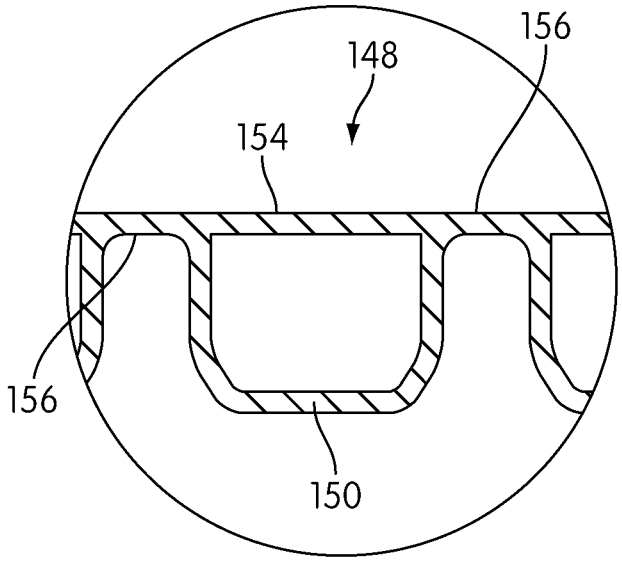
FIG. 5B is a cross-sectional view of a portion of the forefoot chamber of FIGS. 2 and 4 taken along line 5B-5B of FIG. 4.

In the configuration shown in FIG. 3, chamber arms 150 of heel chamber 146 extend from a central region 152 positioned below the user's heel during use. In the configuration shown in FIG. 4, arms 150 of forefoot chamber 148 can include a series of cross arms 158 generally configured in a transverse arrangement extending between lateral and medial sides of article of footwear 110. Forefoot chamber 148 can further include one or more conduits 160 and 162 interconnecting various arms 150 to allow fluid flow during use and permit particular cushion and attenuation features.

Figure 6:
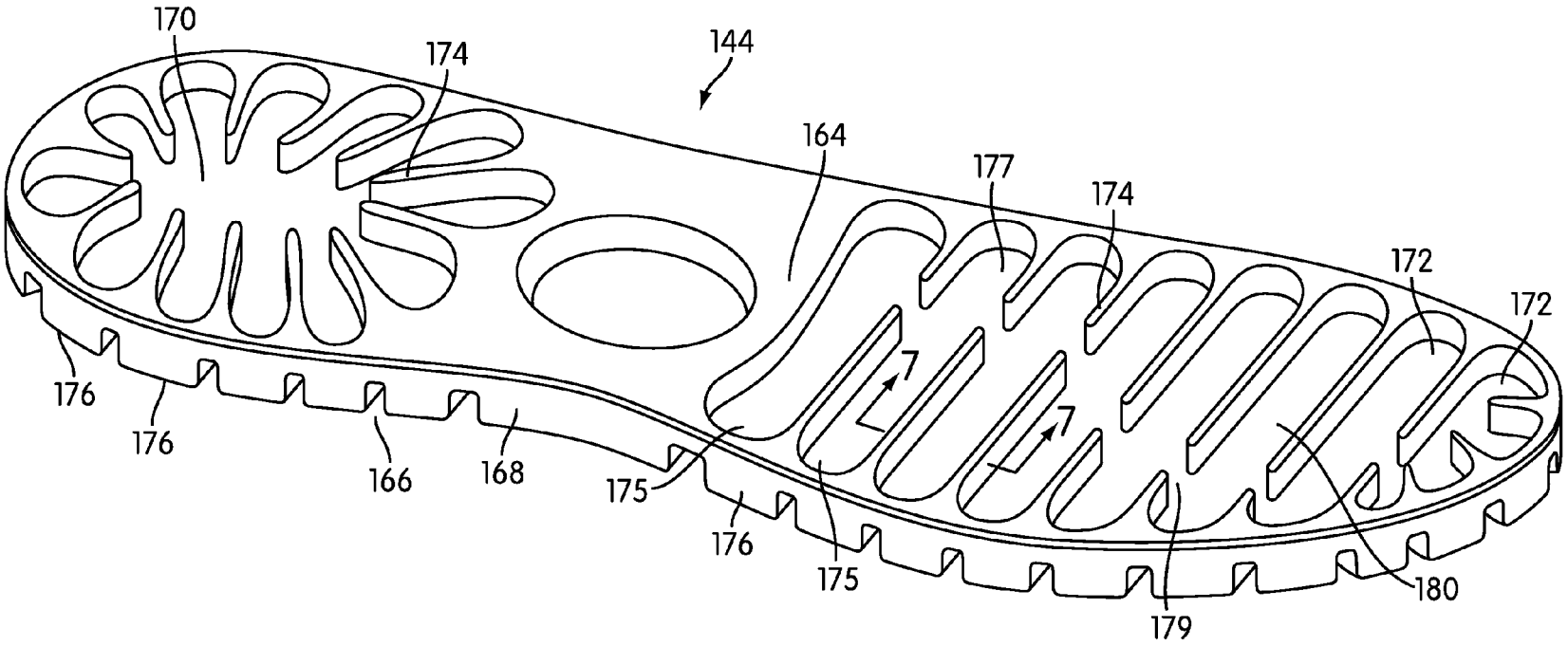
FIG. 6 is a perspective view of the framework of FIG. 2.
Figure 7:
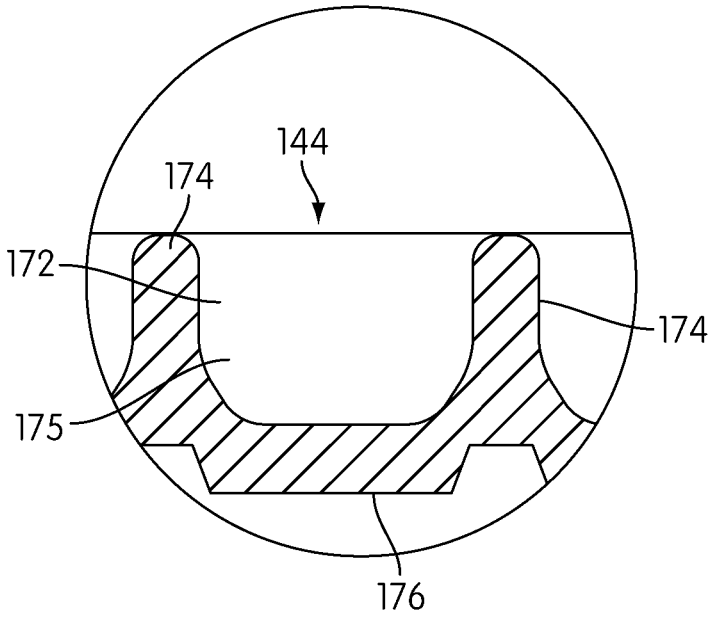
FIG. 7 is a cross-sectional view of a portion of the framework of FIGS. 2 and 6 taken along line 7-7 of FIG. 6.

Referring to FIGS. 6 and 7, framework 144 can include a top portion 164, a bottom portion 166, side portions 168, a heel recess 170 and a forefoot recess 180. The recess can be formed in framework 144 at top portion 164 and extend downward toward bottom portion 166. Each recess 170 and 180 can be configured to receive lower portions 167 of the heel and forefoot chambers. As shown, recesses 170 and 180 each include a plurality of channels 172 separated by support walls 174. The channels can correspond with arms 150 and the conduits 160, 162 of chambers 146 and 148, and can include cross channels 175, intermediate fore-aft channel 177 and forward fore-aft channel 179. Outsole features 176 can be formed on bottom portion 166 of the framework for interacting with the ground during use. In other configurations, openings can be formed through the framework, and heel chamber 146, forefoot chamber 148, or both can extend therethrough and protrude outward as part of an outsole structure (see FIGS. 10-11).

As noted above, resilient framework 144 can be formed from a variety of materials, such as a resilient foam material like polyurethane or ethylvinylacetate, and can include a primary material and one or more secondary materials incorporated therein or attached thereto. For instance, resilient framework 144 can be formed from a primary polymer foam material and can include one or more additional support structures (not shown) molded therein, such as reinforcing structures, plates, spring structures, moderators, bridge structures, etc.

The example chambers of FIGS. 3-5B can cooperate with framework 144 shown in FIGS. 6 and 7 to provide one type of cushioning and reaction at typical regions of high stress and/or initial contact with the ground, such as under the user's heel and intermediate portions of the forefoot, and another type of cushioning and reaction thereafter under various other portions of the foot, such as under a forward portion of the forefoot. As discussed further below, framework-chamber arrangement 142 and other framework-chamber arrangements can also provide various other advantages, such as allowing cushion and reaction forces to be configured as appropriate for certain types sports or for other special uses of the article of footwear.

Figure 8:
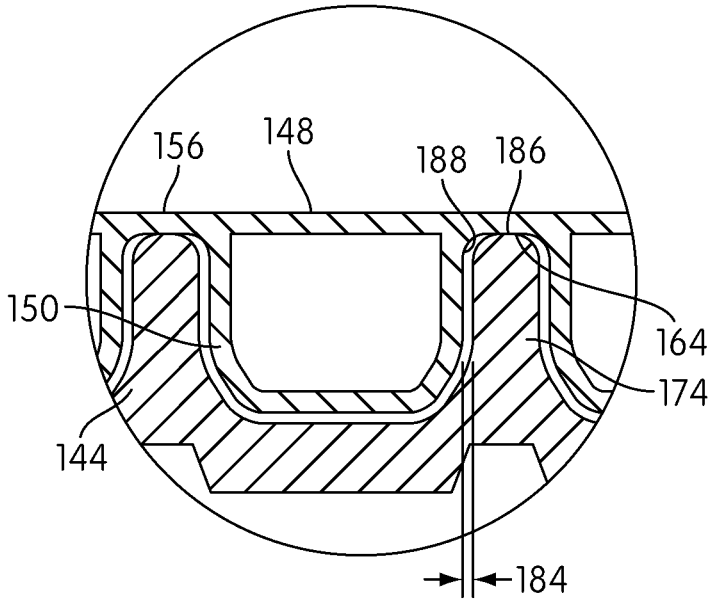
FIG. 8 is a cross-sectional view of a portion of the framework-chamber arrangement of FIG. 2 taken along line 8-8 of FIG. 2.

FIG. 8 is a cross-sectional view of a portion of framework 144 in assembled condition with forefoot chamber 148 as taken through part of forefoot recess 180. As shown, a gap 184 can exist between outer walls of forefoot chamber 148 and inner portions of support walls 174 when in a relaxed state (e.g., while not contacting the ground), which can occur in configurations having little or no pressure within forefoot chamber 148 and in low chamber pressure configurations. In other cases, forefoot chamber 148 can directly contact inner portions of support walls 174 with little or no gap 184. In yet other cases, forefoot chamber 148 can have an interference fit with inner portions of support walls 174 such that support walls 174 are generally compressed between adjacent chamber arms 150. In additional cases, combinations of fits with and without gaps between chamber arms and framework support arms can exist for different regions of framework-chamber arrangement 142.

As also shown in FIG. 8, chambers 146 and 148 can be attached to framework 144 at its top portion 164 generally along a footbed plane via an interface 186 between top portion 164 and an underside 188 of chamber web members 156. As such, framework 144 and chambers 146 and 148 can be configured to have a bond only existing generally along the footbed plane at interface 186. In other cases, additional bonds can exist, such as between portions of chamber arms 150 and adjacent portions of framework support walls 174. The bonds can include adhesive bonds or other types of connections, such as mechanical connections and connections formed via component geometry or while molding the framework. Insole 140 can be attached to framework-chamber arrangement 142 in similar ways. In one configuration, framework 144 and chambers 146 and 148 can include an adhesive bond along the footbed plane as described above, and insole 140 can be attached in a similar manner via an adhesive bond between an underside of insole 140 and an upper portion of framework-chamber arrangement 142. Such a configuration can allow sole structure 130 to be quickly and easily assembled. It can further permit sole structure 130 to be a soft and lightweight assembly having few attachments or structural features.

Although lightweight and soft, such a configuration can provide resilient support providing many advantages. In particular, framework 144 can provide an evenly distributed structure around chamber arms 150 to position and retain the chamber arms in a manner that is substantially free of bonds while cooperating with them to provide additional cushioning and force responsiveness. Further, as noted above, gaps 184 can exist between portions of the resilient framework and the chamber arms in a relaxed state. As such, a first type of cushioning can be provided at an early stage of engagement between the article of footwear and the ground based primarily on compression of the resilient framework. A second type of cushioning different from the first type can also be provided at a later stage of ground engagement based on interfering contact between compressed portions of the resilient framework and the one or more fluid-filled chambers. In some configurations, a third type of cushioning may be provided at an even earlier stage of ground engagement where portions of cushioning chambers extend through the resilient framework to an outsole region to form outsole pods, the third type of cushioning being based primarily on compression of the outsole pods. Further, framework-chamber arrangement 142 can provide various other advantages, such as allowing cushion and reaction forces to be configured as appropriate for certain types of sports or for other special uses.

For example, conduits 160 and 162 of forefoot chamber 148 can interconnect some of the cross arms 158 to direct fluid flow during use and provide particular advantages. In the configuration shown in FIG. 4, intermediate conduit 160 of forefoot chamber 148 can interconnect some of intermediate cross arms 158 in a general fore-aft direction at a medial portion of the forward chamber. In addition, forward conduit 162 can interconnect some of the forward cross arms in a general fore-aft direction. Such a configuration can assist with reducing or correcting supination during foot roll by appropriately directing fluid flow and pressure within chamber 148. In particular, soft cushioning can be provided at the intermediate medial portion of the sole during an intermediate portion of the foot roll while more rigid support is being provided at a lateral portion of the sole. Further, firm cushioning can be provided at the forefoot lateral portion of the sole toward the end of the stride. As such, the foot can be encouraged toward a more neutral angle during foot roll to compensate for supination. As discussed further below, the chamber arms can be interconnected in assorted other configurations to provide various features, particularly when cooperating with a related framework.

Figure 9:
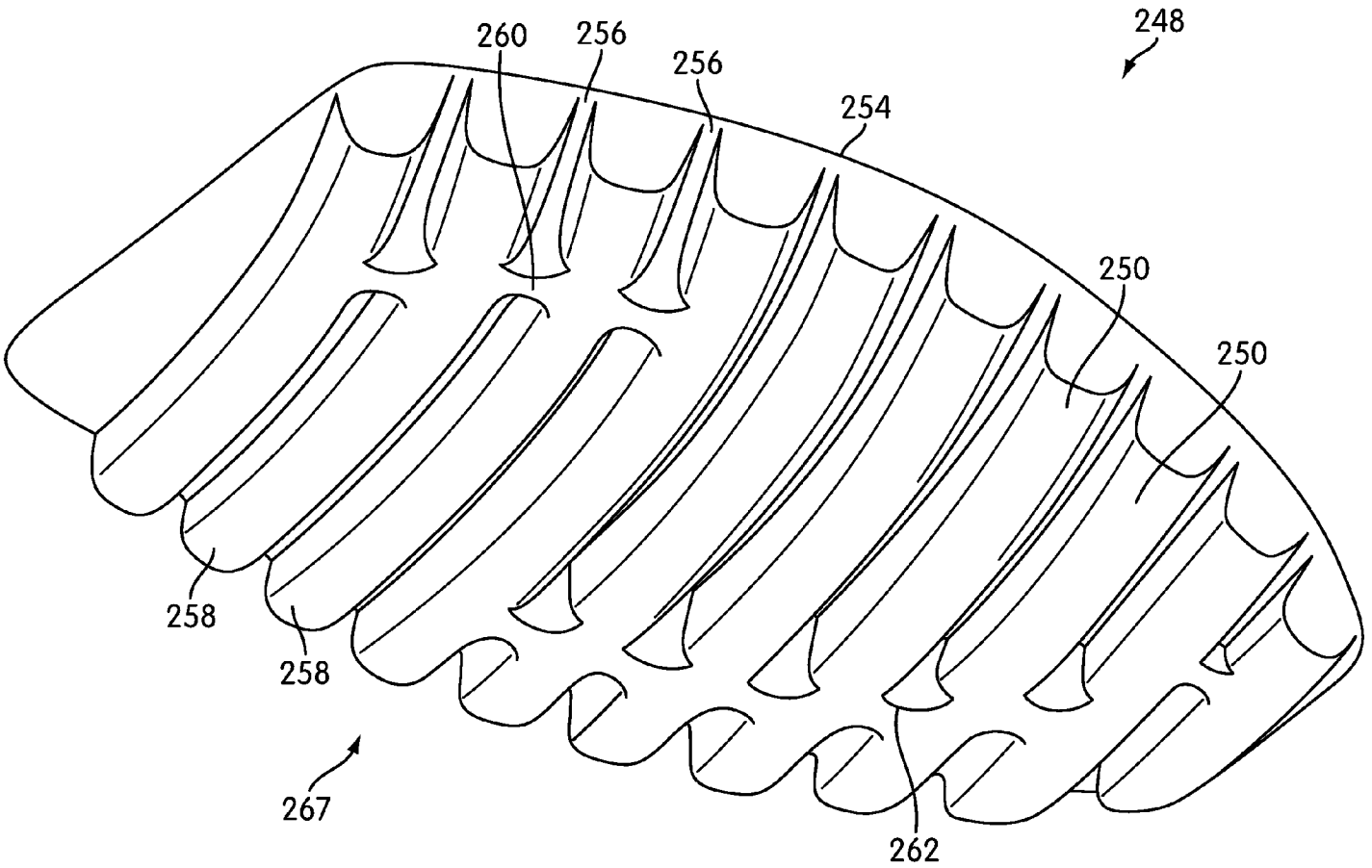
FIG. 9 is a perspective view of another configuration of a forefoot chamber viewed from the lower side of the chamber.

FIG. 9 shows another configuration of a forefoot chamber 248 viewed from a lower portion 267 of the chamber, which generally includes the features described above along with forefoot chamber 148 except as noted hereafter. As shown, forefoot chamber 248 can include a plurality of chamber arms 250 that can be interconnected by a web 254 including web members 256 connecting adjacent chamber arms 250 to one another. Arms 250 can include a series of cross arms 258 generally configured in a transverse arrangement extending between its lateral and medial regions, intermediate fore-aft conduit 260 interconnecting some of the intermediate cross arms 258 in a general fore-aft direction at a lateral portion of the chamber and forward fore-aft conduit 262 interconnecting some of the forward cross arms in a fore-aft direction. Such a configuration can assist with reducing over-pronation during foot role by appropriately directing fluid flow and pressure. In particular, soft cushioning can be provided at the intermediate lateral portion of the sole during the medial roll of the foot with more rigid cushioning being provided at the forefoot lateral portion of the sole toward the end of the foot roll. As such, the foot can be encouraged toward a more neutral angle during foot roll to compensate for over-pronation.

Figure 10:
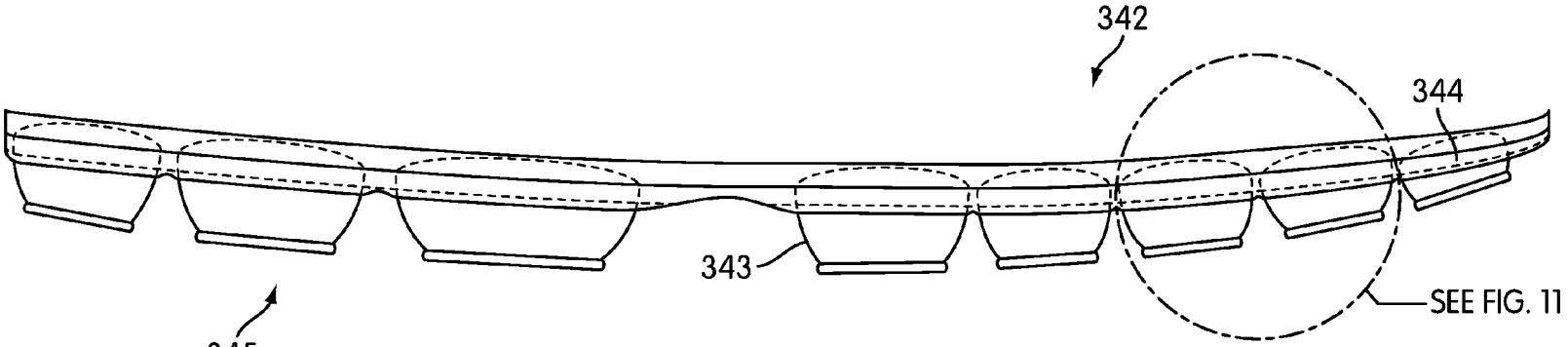
FIG. 10 is a side view of another configuration of a framework-chamber arrangement for an article of footwear including outsole pods extending through the resilient framework to an outsole portion of an article of footwear.
Figure 11:
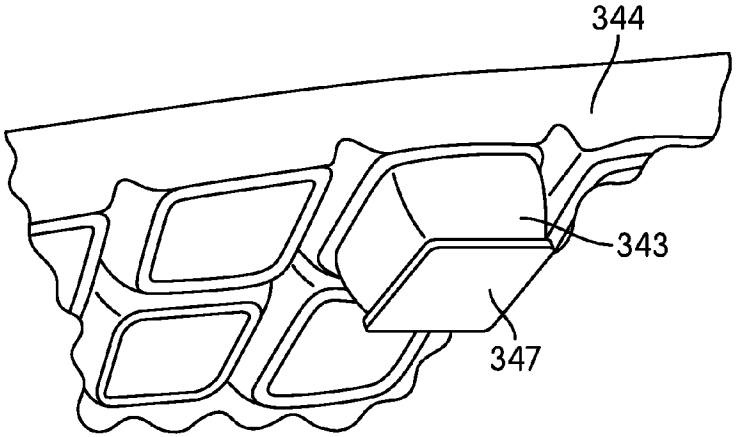
FIG. 11 is perspective view of a portion of the framework-chamber arrangement of FIG. 10 as viewed from the outsole, which is shown with a single outsole pod for clarity.

FIGS. 10-11 show another configuration of a framework-chamber arrangement 342 including outsole pods 343 extending through a resilient framework 344 to an outsole portion 345. Outsole pods 343 can be formed as downward extensions from chamber arms 150 or 250 of the forefoot chambers shown in FIGS. 4 and 9 or of other forefoot chamber configurations. Outsole pads 347 can be attached to distal ends of outsole pods 343 for contacting the ground during use. Framework-chamber arrangement 342 can provide a type of cushioning at an early stage of ground engagement during foot roll based primarily on compression of the outsole pods. Another type of cushioning can be provided thereafter based primarily on compression of the resilient framework, which can be followed by a further type of cushioning at a later stage of ground engagement based on interfering contact between compressed portions of the resilient framework and the one or more fluid-filled chambers.

Figure 12:
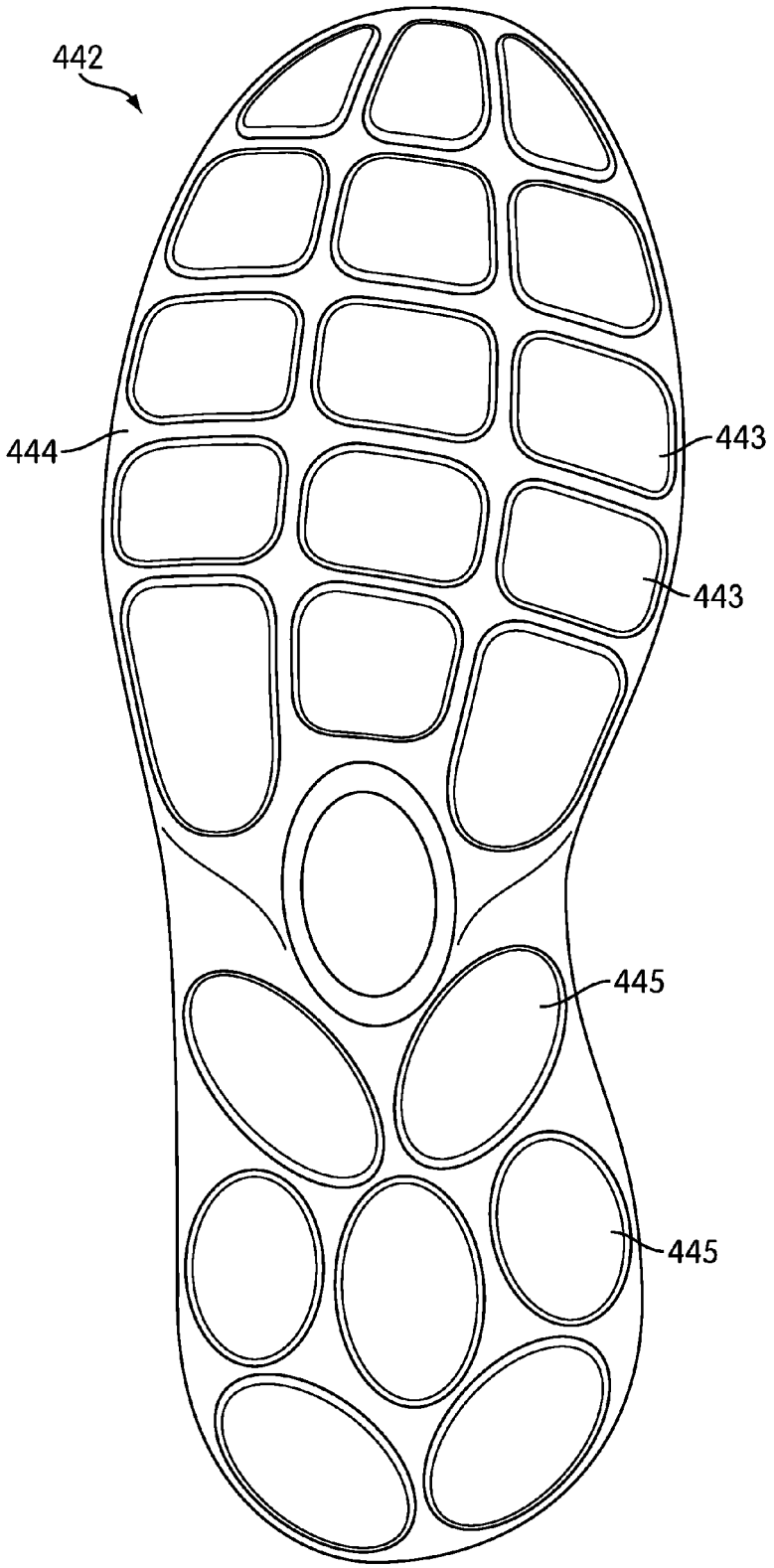
FIG. 12 is a bottom view another configuration of a framework-chamber arrangement for an article of footwear.

FIG. 12 shows another configuration of a framework-chamber arrangement 442 including forefoot outsole pods 443 and heel outsole pods 445 extending through a resilient framework 444. As shown in FIG. 12, forefoot outsole pods 443 are bounded by portions of resilient framework 444 extending from lateral side 14 to medial side 15 of framework-chamber arrangement 442. Forefoot outsole pods 443 are additionally bounded by portions of resilient framework 444 extending from a heel region 13 to a forefoot region 11 of framework-chamber arrangement 442. Some forefoot outsole pods 443 may have a substantially square-shaped or substantially rectangular-shaped configuration. Additionally, some forefoot outsole pods 443 may have a substantially triangular-shaped configuration, or a substantially trapezoidally-shaped configuration. Heel outsole pods 445, in contrast, have a substantially oval-shaped or ellipsoid-shaped configuration. In some configurations, some heel pods 445 may have a substantially circular-shaped configuration.

Figure 13:
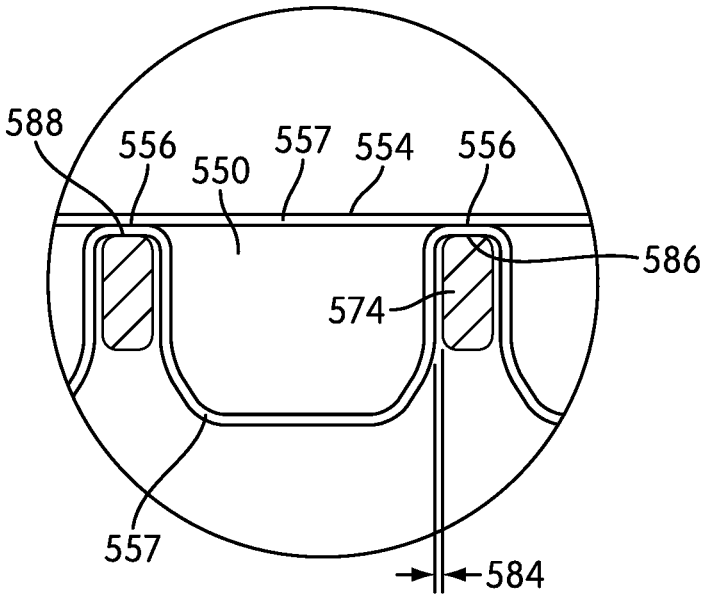
FIG. 13 is a cross-sectional view of a portion of another configuration of a framework-chamber arrangement for an article of footwear, corresponding with FIG. 8.

FIG. 13 shows a close cross-sectional view of a portion of another configuration of a framework-chamber arrangement, corresponding with FIG. 8. As shown in FIG. 13, chamber arms 550 can be interconnected by a web 554. The interconnecting web 554 can be formed from a top portion of a fluid-filled heel chamber, a fluid-filled forefoot chamber, or a fluid-filled chamber corresponding with any other portion or portions of the foot. Furthermore, the interconnecting web 554 can include web members 556 connecting adjacent chamber arms 550 to one another. Web 554 and interconnecting web members 556 can have various configurations as appropriate for desired features such as flexibility between the chamber arms. As shown in FIG. 13, a barrier 557, which may be formed from a polymer material, may enclose a pressurized fluid. Barrier 557 in turn forms the chamber including chamber arms 550, interconnecting web 554, and web members 556.

In FIG. 13, the chamber including chamber arms 550, interconnecting web 554, and web members 556 is included with a resilient framework as part of a framework-chamber arrangement. Gaps 584 exist between chamber arms 550 and support walls 574 of the resilient framework. Other configurations may have larger or smaller gaps 584, or may have no gaps at all. In still further configurations, chamber arms 550 may generally compress any support walls 574 between them. The chamber may be attached to the framework generally along a footbed plane at an interface 586 between a top portion of support walls 574 and an underside 588 of web members 556. As such, the framework and the chamber can be configured to have a bond existing generally along the footbed plane at interface 586. In other cases, additional bonds can exist, such as between portions of chamber arms 550 and adjacent portions of framework support walls 574.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications can be made to the configurations described above without departing from the scope of the present invention, as defined by the appended claims.

The invention claimed is:

1. An article of footwear having an upper and a sole structure secured to the upper, the sole structure comprising:

a fluid-filled chamber forming a plurality of arms extending laterally between upper and lower regions of the fluid-filled chamber; and a resilient framework formed from a polymer foam material, the framework receiving the lower region of the fluid-filled chamber within a recess formed in an upper portion of the framework, the recess including a plurality of lateral channels receiving lower regions of the chamber arms;

wherein the fluid-filled chamber is retained within the framework generally free of bonds between the lower regions of the chamber arms and the framework.

2. The article of footwear of claim 1, wherein the fluid-filled chamber and the framework are configured to cooperate to provide multiple-stage cushioning.

3. The article of footwear of claim 1, wherein the fluid-filled chamber forms at least one conduit interconnecting two or more of the plurality of chamber arms and is configured to direct fluid flow, and the framework includes at least one interconnecting channel corresponding with the at least one conduit that interconnects two or more of the plurality of channels.

4. The article of footwear of claim 3, wherein the plurality of chamber arms of the fluid-filled chamber includes cross arms oriented between a medial side region and a lateral side region of the article of footwear, and the plurality of channels of the framework includes cross channels generally oriented between the medial and lateral side regions of the article of footwear, the cross channels receiving and retaining the lower regions of the cross arms without forming bonds with the lower regions of the cross arms.

5. The article of footwear of claim 4, wherein the fluid-filled chamber is a forefoot chamber disposed proximate a forefoot portion of the article of footwear.

6. The article of footwear of claim 5, wherein the at least one conduit includes a fore-aft conduit interconnecting two or more of the cross arms in a generally fore-aft direction and the at least one channel includes a fore-aft channel interconnecting two or more of the cross channels in a generally fore-aft direction.

7. The article of footwear of claim 6, wherein the fore-aft conduit and corresponding fore-aft channel are disposed toward the medial side of the article of footwear and are configured to reduce supination.

8. The article of footwear of claim 6, wherein the fore-aft conduit and corresponding fore-aft channel are disposed toward the lateral side of the article of footwear and are configured to reduce over-pronation.

9. The article of footwear of claim 1, wherein peripheral portions of the chamber arms are spaced apart from adjacent portions of corresponding channels while in a relaxed state.

10. The article of footwear of claim 9, wherein the fluid-filled chamber has an internal pressure of about zero while in a relaxed state in comparison with atmospheric pressure.

* * * * *